US010384691B2

(12) United States Patent
Talbot et al.

(10) Patent No.: US 10,384,691 B2
(45) Date of Patent: Aug. 20, 2019

(54) METHOD AND SYSTEM FOR SETBACK MODULAR PLATFORM WITH INTEGRATED SHUTTLE PLATFORM

(71) Applicant: NATIONAL RAILROAD PASSENGER CORPORATION, Washington, DC (US)

(72) Inventors: Gary Talbot, Wilmington, DE (US); Kyle Giannaula, Philadelphia, PA (US); Robert Kokx, Sterling Heights, MI (US); Christopher Kattola, Sterling Heights, MI (US); Edward Boryn, Commerce Township, MI (US); Toniya Camilleri, Clay, MI (US); Glenn Ludemann, Chesterfield, MI (US)

(73) Assignee: NATIONAL RAILROAD PASSENGER CORPORATION, Washington, DC (US)

( * ) Notice: Subject to any disclaimer, the term of this patent is extended or adjusted under 35 U.S.C. 154(b) by 361 days.

(21) Appl. No.: 15/093,362

(22) Filed: Apr. 7, 2016

(65) Prior Publication Data

US 2016/0297450 A1 Oct. 13, 2016

Related U.S. Application Data

(60) Provisional application No. 62/144,739, filed on Apr. 8, 2015.

(51) Int. Cl.
*B61B 1/02* (2006.01)

(52) U.S. Cl.
CPC ..... *B61B 1/02* (2013.01)

(58) Field of Classification Search
CPC ..... B61B 1/02
See application file for complete search history.

(56) References Cited

U.S. PATENT DOCUMENTS 1,027,828 A * 5/1912 Elektorowicz ..... B61B 1/02 104/31
1,050,937 A * 1/1913 Gallinant ..... B61B 1/02 104/31
1,098,298 A * 5/1914 Porth ..... B61B 1/02 104/31
1,149,759 A * 8/1915 Hedley et al. ..... B61B 1/02 104/31
1,216,560 A * 2/1917 Gallinant ..... B61B 1/02 104/31

(Continued)

*Primary Examiner* — Jason C Smith
(74) *Attorney, Agent, or Firm* — Gerard M. Donovan; Reed Smith LLP

(57) ABSTRACT

A modular platform system includes a setback platform system for a shared track rail system on a ground level. The shared track rail system is usable by a commuter, regional and intercity rail vehicle and a freight vehicle. The setback platform includes a first path at a first height with respect to the ground level. The setback platform also includes a shuttle platform. The shuttle platform is at a second height in a first position different from the first height. The shuttle platform is configured to be moved from the first position to a second position different from the first position. A front edge of the shuttle platform is farther away from a centerline of the shared track rail system if the shuttle platform is in the first portion than if the shuttle platform is in the second position.

19 Claims, 11 Drawing Sheets

(56) References Cited

U.S. PATENT DOCUMENTS

| | | | | | |
|---|---|---|---|---|---|
| 5,517,921 | A * | 5/1996 | Klohn | B61B 1/02 | 104/31 |
| 5,845,579 | A * | 12/1998 | Langley | B61B 1/02 | 104/31 |
| 5,845,580 | A * | 12/1998 | Muller | B61B 1/02 | 104/31 |
| 2001/0042489 | A1* | 11/2001 | Yamaguchi | B61B 1/02 | 104/30 |
| 2010/0043664 | A1* | 2/2010 | Winkelmann | B60R 3/02 | 104/31 |
| 2010/0058949 | A1* | 3/2010 | Lomberty | B61B 1/02 | 104/31 |
| 2012/0120234 | A1* | 5/2012 | Fullalove | B61B 1/02 | 348/143 |
| 2015/0291187 | A1* | 10/2015 | Geddie | B61K 13/04 | 104/31 |
| 2016/0207542 | A1* | 7/2016 | Lieber | E06B 11/022 | |
| 2016/0297450 | A1* | 10/2016 | Talbot | B61B 1/02 | |
| 2018/0170401 | A1* | 6/2018 | Tenet | B61B 1/02 | |

* cited by examiner

METHOD AND SYSTEM FOR SETBACK MODULAR PLATFORM WITH INTEGRATED SHUTTLE PLATFORM

PRIORITY CLAIM

The present application claims priority of U.S. Provisional Application No. 62/144,739, filed Apr. 8, 2015, which is incorporated herein by reference in its entirety.

BACKGROUND

Shared track rail systems are used by freight rail vehicles and commuter, regional and intercity passenger rail vehicles. Freight rail vehicles often transport non-human cargo. Commuter, regional and intercity rail vehicles transport passengers. Regulations for shared track rail systems are sometimes different from regulations for rail systems that are exclusive to one of freight rail vehicles or commuter, regional and intercity rail vehicles. For example, the Federal Railroad Administration (FRA) regulates a distance between a centerline of a shared track rail system and a platform based on the height of the platform relative to the top of rail (TOR). If the platform is at approximately 8 inch above top of rail (ATR) or lower, the platform is considered a low platform, and the distance from the edge of the platform to the centerline of the track is less. All trains will have the ability to pass over the low platform unimpeded. If the platform is higher than 8 inches ATR, the platform is set back further from the centerline of the track depending on if the track is shared use with freight or passenger only. As the height of the platform ATR is increased (up to approximately 48 inches ATR) the platform is setback from the centerline of the track to allow all trains to pass freely. At passenger only track locations, the required horizontal gap between the edge of the high platform (48 inch ATR) and the floor of a passenger train car is approximately 8 inches. However, when wider freight trains share the same tracks with passenger rail cars, the clearance requirement for the high level or level boarding platforms is significantly increased which can result in an approximately 48 inch horizontal gap between the edge of the level boarding platform (setback) and the floor of the passenger rail car. The distance between the centerline of the shared track rail system and the edge of a level boarding platform sometimes results in a gap between a rail car and the platform that must be crossed to board and exit the rail car.

Conventional commuter, regional and intercity rail vehicles often include a steep incline of steps for boarding and exiting the vehicle when the platform used is low level (non-level boarding). Such steps sometimes make entry and exit difficult for some passengers. For example, individuals who use a wheeled mobility device (e.g., wheelchair, motorized assistance vehicle, etc.) are often unable to enter or exit the commuter, regional and intercity rail vehicles without a steep ramp or a station based mobile lift. A setback platform adds additional difficulties with boarding and exiting commuter, regional and intercity rail vehicles because of the gap between the setback platform and the rail vehicle, because of the American Railway Engineering and Maintenance-of-Way Association (AREMA) and FRA regulated distance between the platform and the centerline of the shared rail track system.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

Figure 1:
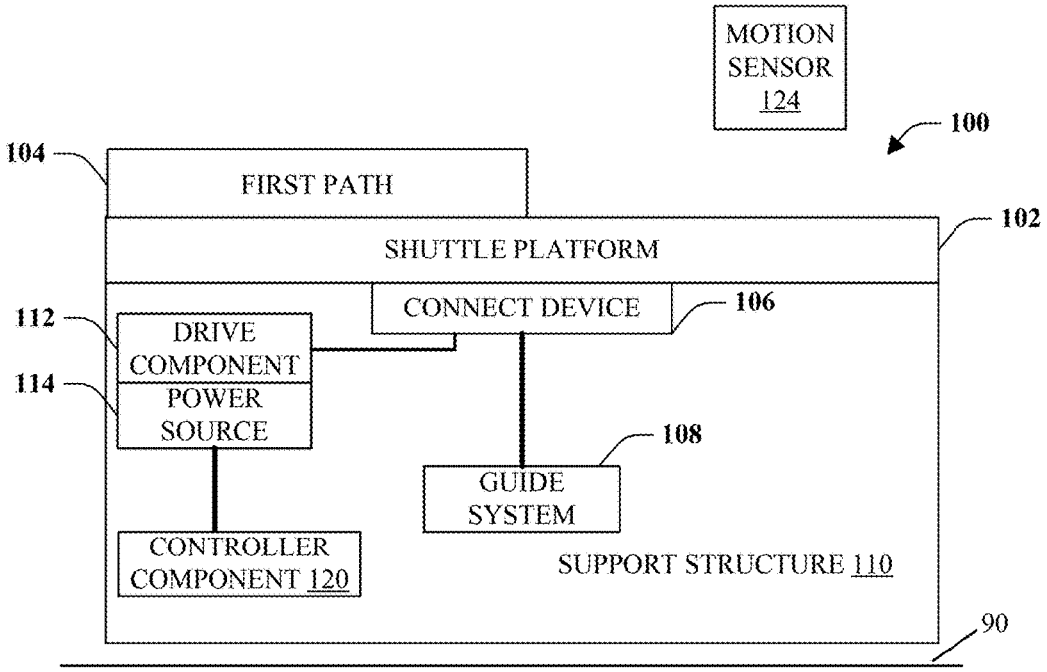
FIG. 1 is an illustration of a setback platform system, in a cross-sectional view, that includes a shuttle platform in a first position in accordance with some embodiments.

APPENDIX A is a document that describes aspects of the claimed subject matter, and this Appendix forms part of this specification;

APPENDIX B is a document that describes aspects of the claimed subject matter, and this Appendix forms part of this specification;

APPENDIX C is a document that describes aspects of the claimed subject matter, and this Appendix forms part of this specification;

APPENDIX D is a document that describes aspects of the claimed subject matter, and this Appendix forms part of this specification;

APPENDIX E is a document that describes aspects of the claimed subject matter, and this Appendix forms part of this specification;

APPENDIX F is a document that describes aspects of the claimed subject matter, and this Appendix forms part of this specification;

APPENDIX G is a document that describes aspects of the claimed subject matter, and this Appendix forms part of this specification; and APPENDIX H is a document that describes aspects of the claimed subject matter, and this Appendix forms part of this specification.

APPENDIX I is a document that describes aspects of the claimed subject matter, and this Appendix forms part of this specification.

DETAILED DESCRIPTION

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

The discussed embodiments relate to methods and systems for a modular platform system configured to facilitate loading a commuter, regional and intercity rail vehicle on a shared track rail system. The shared track rail system is on a ground level that is used by a commuter, regional and intercity rail vehicle and a freight vehicle. The modular platform system includes a shuttle platform configured to be moved in a linear plane that is substantially parallel to the ground level from a first position to a second position and/or the second position to the first position. In some embodiments, the shuttle platform is associated with a setback platform that includes one or more modular platform members. In some embodiments, at least one modular platform member includes one or more frames, a material encased within the one or more frames, at least one heating element, and a wire lead configured to be coupled to a controller component or coupled to an additional wire lead of another modular platform member. In some embodiments, the material encased within the one or more frames comprises concrete. For ease of understanding, this description refers to the material encased within the one or more frames as concrete, but the material encased within the one or more frames is capable of comprising one or more of concrete, cement, a composite material, a binding material, a polymer, a metal, wood, a substantially solidified material, some other suitable material, or combinations thereof.

In some embodiments, the shuttle platform is configured to provide a walkway for one or more passengers to load or unload from a commuter, regional and intercity rail vehicle that runs on the shared track. In some embodiments, the shuttle platform is associated with a setback platform that provides a first path and a second path. The first path is substantially parallel to a centerline of the shared track and the second path is substantially parallel to the centerline of the shared track. The first path is at a first height with respect to the ground level, the second path is at a second height with respect to the ground level, and the first path and the second path are adjacent to one another. In some embodiments, at least a portion of the shuttle platform comprises the second path. In some embodiments, the first height is greater than the second height, and the shuttle platform is configured to be moved in a substantially linear motion from the first position to the second position, wherein at least a portion of the shuttle platform is under the first path in the first position.

In some embodiments, the first position is a non-loading position in which a portion of the shuttle platform is under a portion of the first path. In the non-loading position, the shuttle platform is not deployed and a front edge of the shuttle platform is separated from the centerline of the shared track by a predetermined distance. In some embodiments, the predetermined distance is about nine (9) feet. In some embodiments, the predetermined distance is greater than nine feet. In other embodiments, the predetermined distance is less than nine feet. In some embodiments, the front edge of the shuttle platform is parallel to the centerline of the track. In other embodiments, the front edge of the shuttle platform is substantially parallel to the centerline of the track. In some embodiments, the front edge of the shuttle platform has one or more portions that are separated from the centerline of the track by a distance other than the predetermined distance.

In some embodiments, the shuttle platform includes one or more railings configured to provide a visual warning and physical protection for safety. In some embodiments, the shuttle platform includes one or more motion sensors configured to detect a motion. In some embodiments, a signal is generated by the one or more motion sensors based on a detected motion that causes an alert to prevent movement of the shuttle platform.

The term "shared track" as used herein (also referred to as a "shared track rail system") can be defined as rail track of a general railroad system that is used for both commuter, regional and intercity rail and freight railroad operations.

The term "vehicle" as used herein can be defined as a mobile machine or a moveable transportation device that transports at least one of a person, people, or a cargo. For instance, a vehicle can be, but is not limited to being, a rail car, an intermodal container, a locomotive, a commuter, regional and intercity rail car, or other suitable vessel for transporting at least one of a person, people or cargo.

The term "component" as used herein can be defined as a portion of hardware, a portion of software, or a combination thereof. A portion of hardware can include at least a processor and a portion of memory, wherein the memory includes an instruction to execute. Additionally, "component" as used herein includes, but is not limited to: any programmed, programmable, or other electronic device or portion thereof that can store, retrieve, and/or process data; one or more computer readable and/or executable instructions, stored on non-transitory computer-readable medium/media, that cause an electronic device to perform one or more functions, actions, and/or behave in a desired manner as specified in the instructions; or combinations thereof.

In some embodiments, the terms "component" and "system," as well as forms thereof may intend to refer to a computer-related entity, either hardware, a combination of hardware and software, software, or software in execution. For example, a component may be, but is not limited to being, a process running on a processor, a processor, an object, an instance, an executable, a thread of execution, a program, and/or a computer. By way of illustration, both an application running on a computer and the computer can be a component. One or more components may reside within a process and/or thread of execution and a component may be localized on one computer and/or distributed between two or more computers.

The word "exemplary" or various forms thereof are used herein to mean serving as an example, instance, or illustration. Any aspect or design described herein as "exemplary" is not necessarily to be construed as preferred or advantageous over other aspects or designs. Furthermore, examples are provided solely for purposes of clarity and understanding and are not meant to limit or restrict the claimed subject matter or relevant portions of this disclosure in any manner. It is to be appreciated a myriad of additional or alternate examples of varying scope could have been presented, but have been omitted for purposes of brevity.

Furthermore, to the extent that the terms "includes," "contains," "has," "having" or variations in form thereof are used in either the detailed description or the claims, such terms are intended to be inclusive in a manner similar to the term "comprising" as "comprising" is interpreted when employed as a transitional word in a claim.

Figure 2:
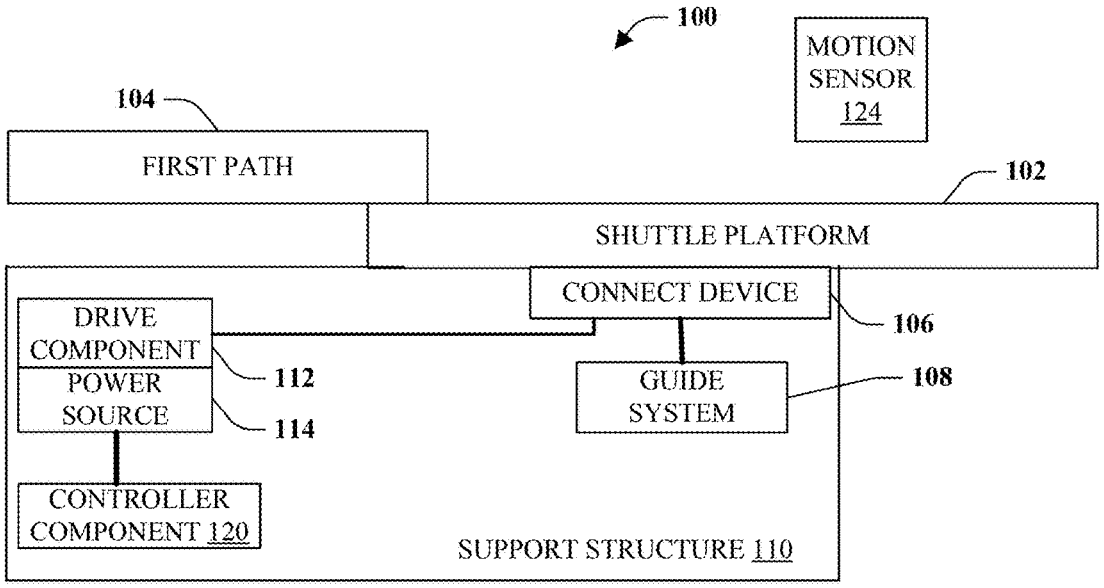
FIG. 2 is an illustration of a setback platform system, in a cross-sectional view, that includes a shuttle platform in a second position in accordance with some embodiments.

FIGS. 1-2 are cross-sectional views of a setback platform system 100, in accordance with some embodiments. FIGS. 3-6 are top views of a shuttle platform 102 in accordance with some embodiments.

FIG. 1 illustrates a setback platform system 100 with the shuttle platform 102 in a first position. At least a portion of the shuttle platform 102 is underneath a first path 104 in the first position. In some embodiments, a portion of the shuttle platform 102 is optionally underneath the first path 104 in the first position. In other embodiments, no portion of the shuttle platform 102 is underneath the first path 104 in the first position. In some embodiments, the shuttle platform 102 is entirely underneath the first path 104 in the first position.

Figure 5:
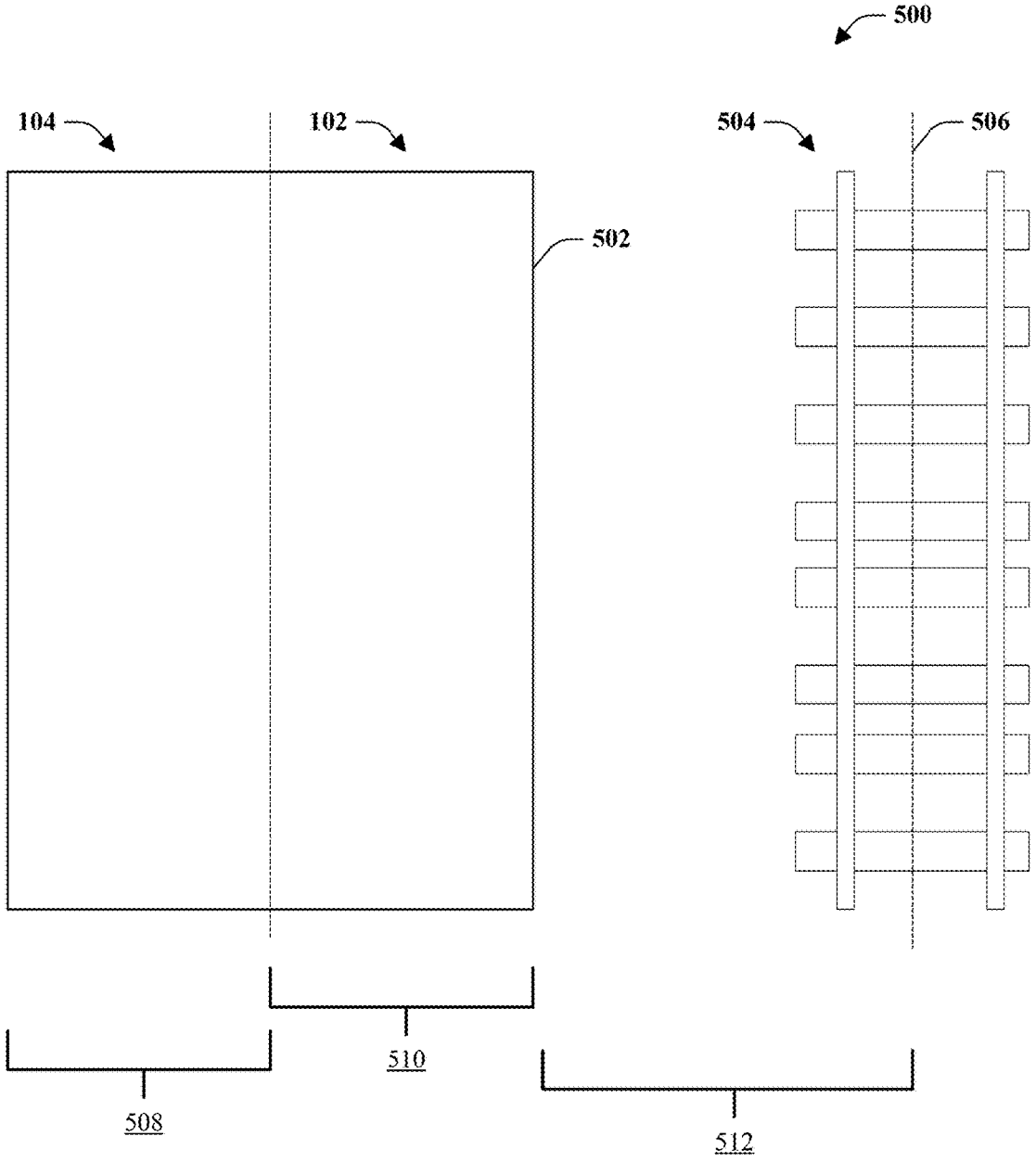
FIG. 5 is an illustration of a setback platform system, in a top view, with a shuttle platform in a first position in accordance with some embodiments.
Figure 6:
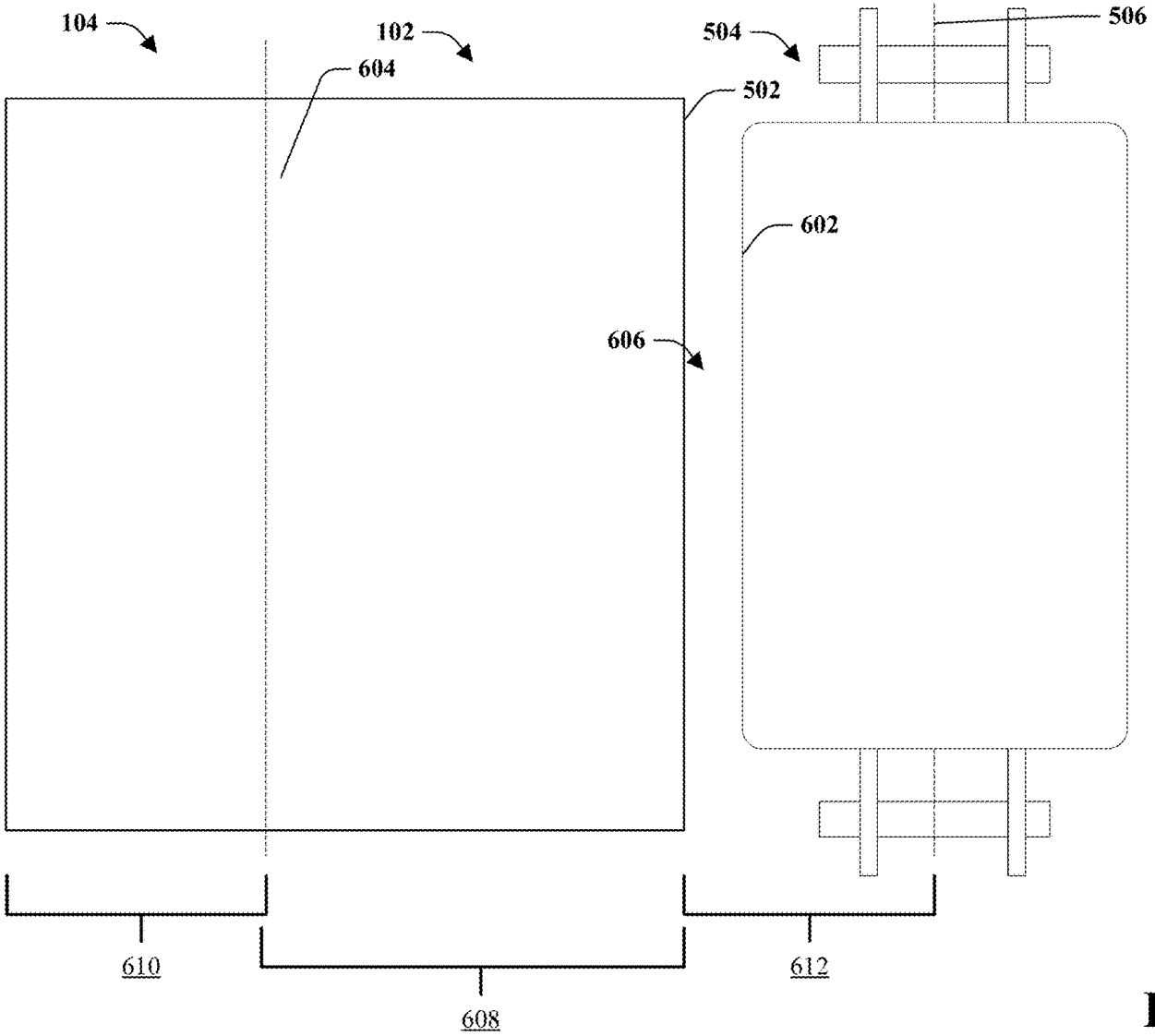
FIG. 6 is an illustration of a setback platform system, in a top view, with a shuttle platform in a second position in accordance with some embodiments.

The first path 104 and the shuttle platform 102 are configured to provide a walkway or path for travel substantially parallel to a centerline 506 of a shared track rail system 504 (shown in FIGS. 5 and 6). The first path 104 is at a first height above the ground level 90. The shuttle platform 102 includes a front edge 502, a rear edge 604 (shown in FIGS. 5 and 6) opposite thereto, wherein the shuttle platform 102 is at a second height above the ground level 90 such that the first height is greater than the second height. In some embodiments, the first path 104 is higher than to the shuttle platform 102 with respect to the ground level to facilitate moving the shuttle platform 102 to underneath the first path 104.

The setback platform system 100 includes the shuttle platform 102 and the first path 104. The setback platform system 100 is configured as a structure for loading and/or unloading of passengers onto a commuter, regional and intercity rail vehicle on a shared track system. In some embodiments, the setback platform system 100 is a structure that is above ground level. FRA regulations establish that a distance of approximately nine (9) feet should exist between the centerline of the shared track and the setback platform to allow clearance for freight vehicles and commuter, regional and intercity rail vehicles that use the shared track. In some embodiments, a predetermined distance exists between the setback platform system 100 and the centerline 506 of a shared track rail system 504 (shown in FIG. 5), resulting in a gap between the front edge of the setback platform and a vehicle that uses the shared track. The shuttle platform 102 incorporated into the setback platform system 100 is configured to mitigate the gap by moving from the first position to the second position and to restore the predetermined distance by moving from the second position to the first position.

The shuttle platform 102 includes a connect device 106 configured to couple and decouple the shuttle platform 102 to a drive component 112. The coupling and/or decoupling is at least one of a powered, automated or manual process, or a combination thereof. The drive component 112 is configured to move the shuttle platform 102 in a linear motion in a plane substantially parallel to the ground level. In some embodiments, the drive component 112 is configured to cause the shuttle platform to move in a non-linear motion toward and/or away from the centerline of the shared track rail system.

Figure 3:
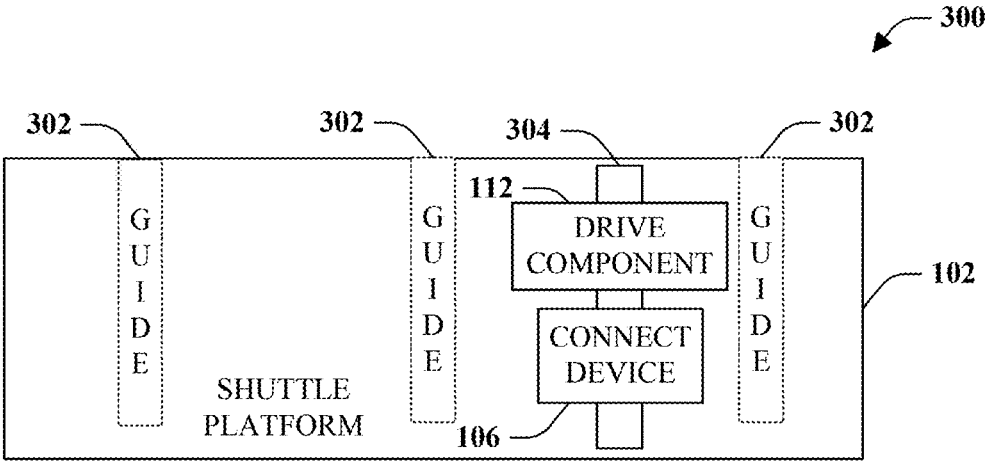
FIG. 3 is an illustration of a shuttle platform, in a top view, that includes a shuttle platform in a first position in accordance with some embodiments.
Figure 4:
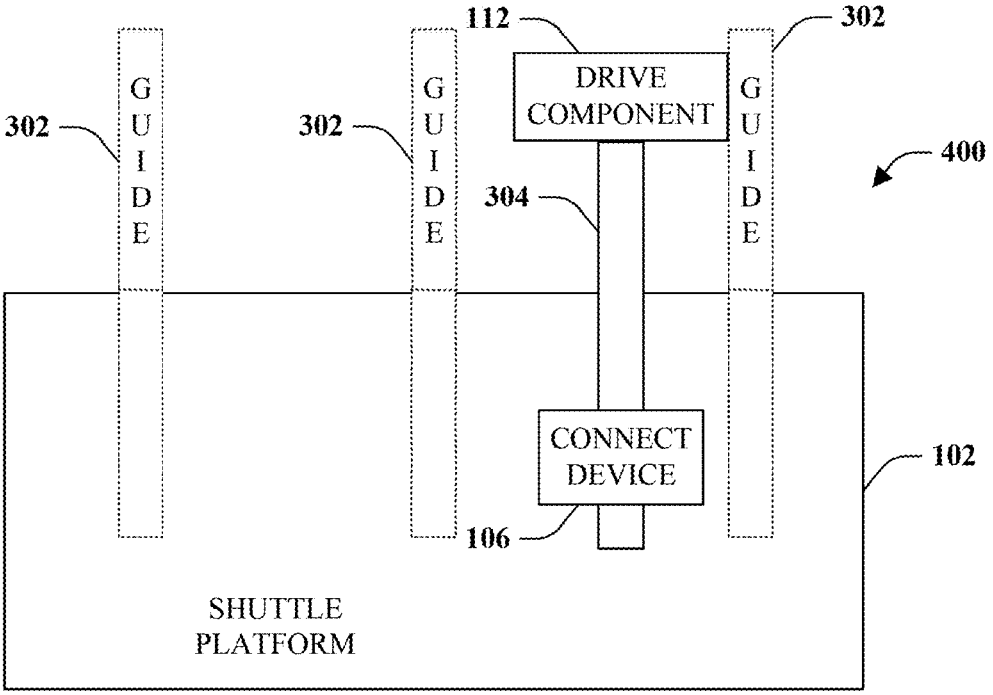
FIG. 4 is an illustration of a shuttle platform, in a top view, that includes a shuttle platform in a second position in accordance with some embodiments.

The shuttle platform 102 includes a guide system 108 that comprises one or more rail guides 302 (e.g., illustrated in FIGS. 3 and 4). In some embodiments, a shaft 304 is configured to be used with the drive component 112 to actuate the shuttle platform 102 between the first position and the second position (and vice versa). In some embodiments, the drive component 112 is powered by a power source 114. In some embodiments, shuttle platform 102 includes a controller component 120 configured to control motion of the shuttle platform 102.

In some embodiments, the controller component 120 is coupled with a motion sensor 124 configured to detect motion. The controller component 120 is configured to prevent the shuttle platform from being moved from the first position to the second position (and/or vice versa) if a motion is detected. A detected motion, for example, is indicative that a person or object is in a path of the shuttle platform 102.

In some embodiments, the controller component 120 is configured to receive and/or transmit wireless signals related to control of the shuttle platform 102. In some embodiments, a signal is communicated from a commuter, regional and intercity rail vehicle on the shared track that indicates a request for deployment of the shuttle platform 102 from the first position to the second position, and the controller component is configured to cause the shuttle platform 102 to be deployed based on the signal. In some embodiments, a signal is communicated from the controller component 120 to a device associated with one or more commuter, regional and intercity rail vehicles indicating a state of the shuttle platform 102. In some embodiments, the state of the shuttle platform 102 comprises one or more of a status condition, an error code, an alert, a failure notification, a portion of text, a graphic, an audible signal, a visual signal, or other suitable status indication or indicator.

In some embodiments, the controller component 120 is configured to receive and/or transmit wireless signals related to control of a heating element of one or more modular platform members that are coupled or arranged to form the setback platform system 100. In some embodiments, the setback platform system 100 includes one or more controller components configured to manage motion, heating elements, sensors, motion sensors, railing movement, barriers, doors, lights, audible signals, weight sensors, and/or other devices, components, or systems.

Referring to FIGS. 1-6, the shuttle platform 102 is configured to move from the first position (illustrated in FIG. 1) to the second position (illustrated in FIG. 2) in to mitigate a gap 606 that exists between the front edge 502 of the shuttle platform 102 and an edge of a vehicle 602 on the shared track located at or near the setback platform system 100. FIG. 1 illustrates a cross-sectional view of the setback platform system 100 with the shuttle platform 102 in a first position that allows a freight vehicle to travel on the shared track and/or allows a commuter, regional and intercity rail vehicle to depart after loading and/or unloading passengers. In some embodiments, the setback platform system 100 is configured to allow a freight vehicle to travel on the shared track in accordance with FRA regulations.

FIG. 2 is a cross-sectional view of the setback platform system 100 with the shuttle platform 102 in a second position that allows for loading and/or unloading of passengers to a commuter, regional and intercity rail vehicle on a shared track rail system.

FIG. 3 is a top view 300 of the shuttle platform 102 without the first path 104.

FIG. 4 is a top view 400 of the shuttle platform 102 without the first path 104.

FIG. 5 is a top view of a setback platform system 500 that illustrates a shared track rail system 504 having a centerline 506. The shuttle platform 102 includes a front edge 502 that is a distance 512 from the centerline 506. A portion of the shuttle platform 102 is optionally under the first path 104 in the first position, and a second portion 510 of the shuttle platform 102 is configured to be used as a second path while in the first position. In other words, while in the first position, the setback platform system 600 can include the first path 104 parallel to the centerline 506 and the second portion 510 of the shuttle platform 102 (also referred to as the second path). In some embodiments, the first path 104 is substantially parallel to the centerline 506.

While in the first position, the front edge 502 of the shuttle platform 102 is a predetermined distance from the centerline 506 of the shared track rail system. In some embodiments, the predetermined distance is about nine (9) feet from the centerline 506 of the shared track rail system, which allows freight vehicles to travel on the shared track rail system in accordance with FRA regulations. In some embodiments, the predetermined distance is greater than nine (9) feet. In other embodiments, the predetermined distance is less than nine (9) feet. In some embodiments, the front edge 502 of the shuttle platform 102 has at least one portion that is separated from the center line 506 of the shared track rail system by a distance other than the predetermined distance, while a different portion of the front edge of the shuttle platform 102 is separated from the center line 506 of the shared track rail system by the predetermined distance.

FIG. 6 illustrates a top view of a setback platform system 600 that illustrates the shared track rail system 504 having the centerline 506 in which a vehicle 602 is traveling thereon. The shuttle platform 102 is configured to move in a linear motion from the first position (e.g., illustrated at least in FIGS. 1, 3, and 5) to a second position which reduces a distance or gap 606 between the front edge 502 and the vehicle 602. The linear motion of the shuttle platform 102 extends toward the centerline 506 such that a rear edge 604 of the shuttle platform is positioned adjacent and proximate a front edge (toward the centerline 506) of the first path 104. In the second position, the portion of the shuttle platform 102 that was underneath the first path 104 is extended toward the centerline 506 exposing a distance 608. By moving the shuttle platform 102 to the second position, the first path 104 still includes a distance 610 to allow passage parallel to the shared track 504 but also the shuttle platform 102 is a distance 612 from the centerline 506 which facilitates loading and/or unloading passengers onto a commuter, regional and intercity rail vehicle that is on the shared track rail system 504.

The shuttle platform 102 can be any suitable shape or size. It is to be appreciated that although the shuttle platform 102 is illustrated as a rectangle shape that holds a volume, but the shuttle platform 102 may optionally be any suitable shape. Moreover, the shuttle platform 102 has a length, width, and thickness, wherein the shuttle platform 102 comprises any suitable material. In some embodiments, the shuttle platform 102 comprises at least one of a concrete, a metal, a steel, a composite material, some other suitable material, or a combination thereof. It is to be appreciated that the material composition of the shuttle platform 102 can be selected by one of ordinary skill in the art and/or with sound engineering judgment without departing from the scope of the subject innovation.

Figure 7:
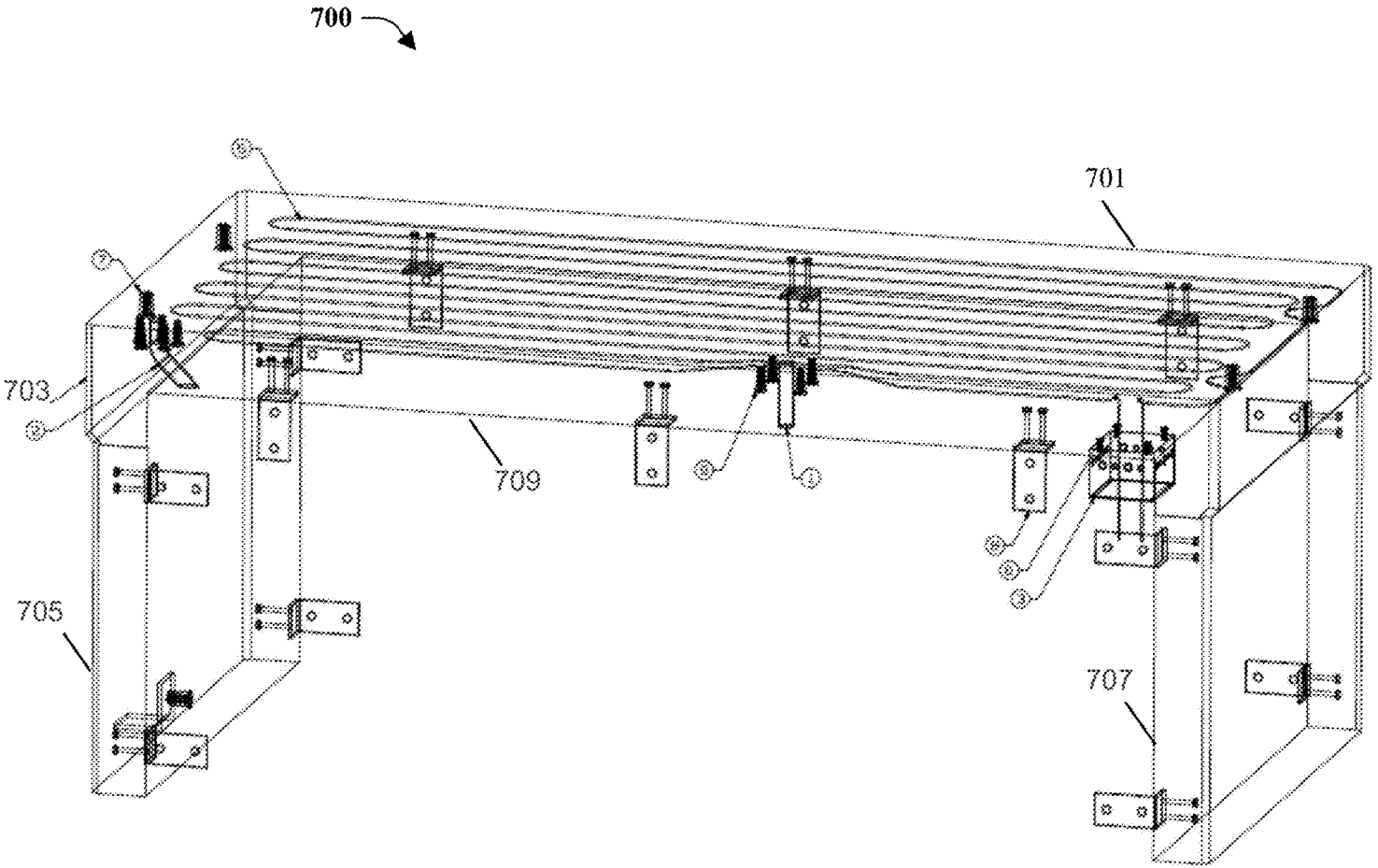
FIG. 7 is an illustration of a modular platform member for a setback platform system in accordance with some embodiments.

FIG. 7 is an isometric view 700 of a modular platform member 701. The setback platform system 100 includes the shuttle platform 102 and one or more modular platform members 701. In some embodiments, each modular platform member 701 is customizable for a ground level or height. In particular, each modular platform member 701 can be coupled together to create the setback platform system 100. Multiple modular platform members are capable of being coupled to one another or positioned adjacent to one another to provide a structure for loading or unloading to a rail system. The modularity of the modular platform members 701 allows for elevation changes from a ground level to a height where passengers load or unload from a rail vehicle. Thus, not only to does the modularity account for the various ground levels or elevations, but the modularity of the modular platform members 701 can account for steps, slopes (up or down), and various shapes or sizes used for the setback platform system.

The modular platform members 701 further include electrical connectivity between one another to allow for a uniform control of the system via the controller component 120 (discussed above in FIG. 1). The controller component 120 can manage one or more modular platform members 701 and respective heating elements. For example, the controller component 120 can control each modular platform member 701 individually, a set of the modular platform members 701, a subset of the modular platform members 701, or a combination thereof. The controller component 120 can further leverage sensors, geographic location, temperature, or other parameters to control the heating element in one or more of the modular platform members of the setback platform system 100.

The modular platform member 701 can include one or more fasteners, members, or connectors. The fasteners, members, or connectors are integrated into or coupled to the modular platform member and configured to receive or attach one or more railings, guardrails, handrails, fences, barriers, or other suitable structures.

The modular platform member 701 comprises a frame assembly 703, wherein the frame assembly 703 includes a first support 705, a second support opposite 707 the first support 705, and a cross surface support 709. Each support comprises one or more of steel, metal, or some other suitable material that can be a frame configured to support a section of the setback platform system 100. The first support 705, the second support 707, and the cross surface support 709 are configured to receive a portion of concrete and frame said portion of concrete. Upon receipt of the concrete or other material, the modular platform member 701 can be used to create the setback platform system 100.

In some embodiments, at least one modular platform member 701 is customizable in terms of dimensions, size, shape, height, etc. In some embodiments, a surface of the modular platform member 701 is stepped, sloped, flat, or a combination thereof.

In an embodiment, concrete is a material used but it is to be appreciated that various materials can be used to create the setback platform system 100 in addition to or as an alternative of concrete.

Figure 8:
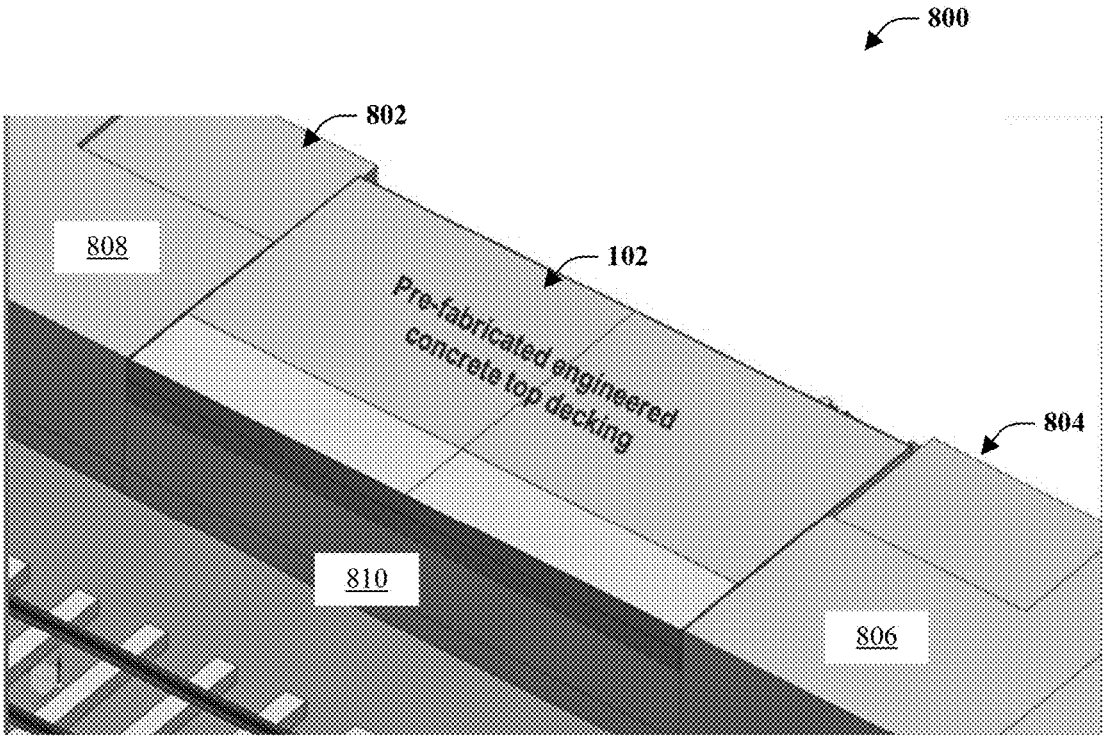
FIG. 8 is an illustration of a setback platform system in accordance with some embodiments.
Figure 9:
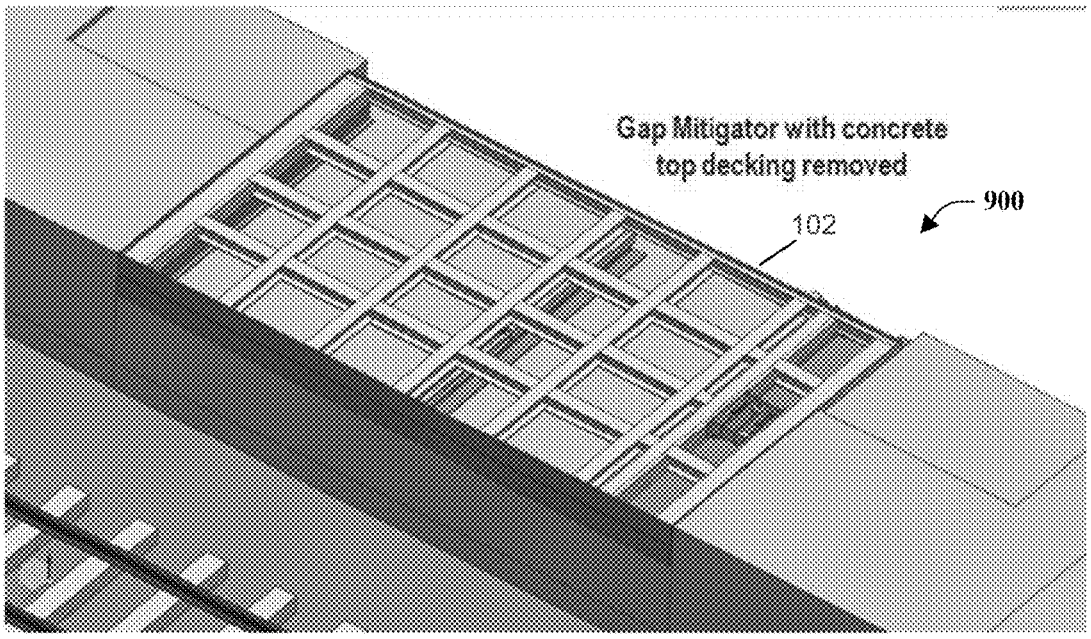
FIG. 9 is an illustration of a setback platform system in accordance with some embodiments.

FIG. 8 illustrates a setback platform system 800 that includes the shuttle platform 102, a modular platform member 804, a modular platform member 804, a modular platform member 806, a modular platform member 808, and modular platform member 810. Each modular platform member can include a frame assembly corresponding to the shape or dimensions for the constructed setback platform system.

Figure 10:
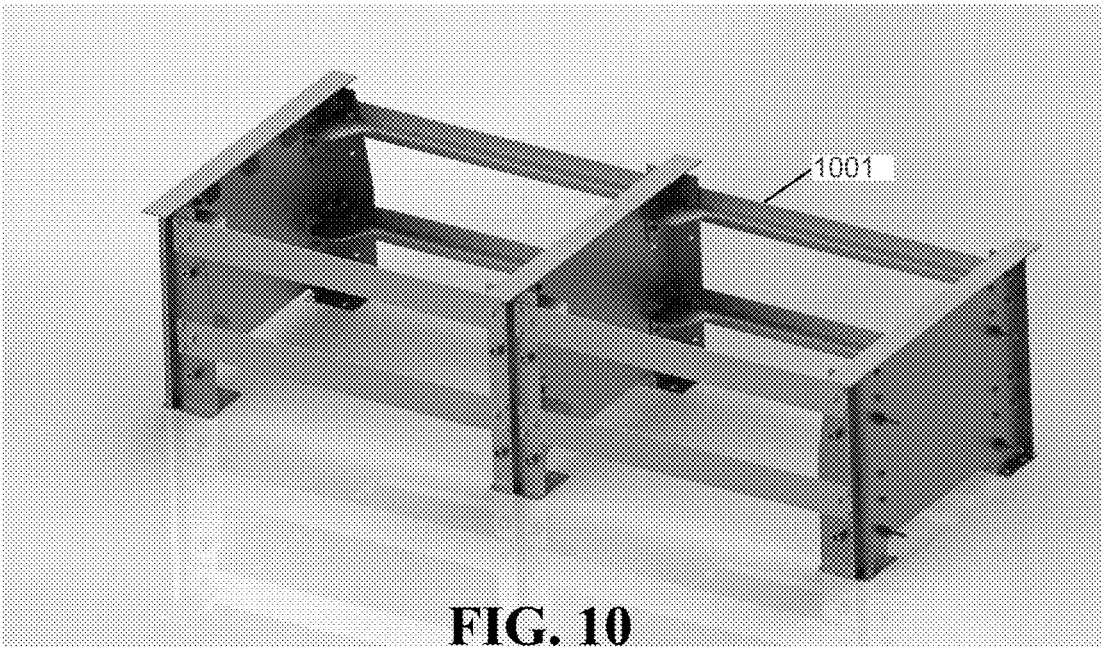
FIG. 10 is an illustration of an embodiment of a frame assembly for a modular platform member used with a setback platform system in accordance with some embodiments.
Figure 11:
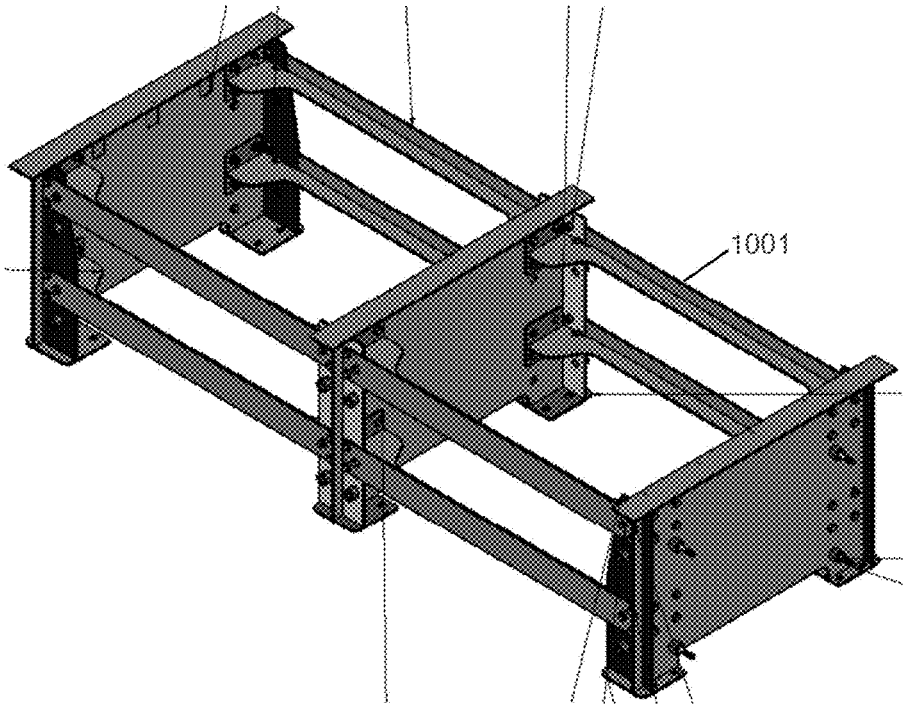
FIG. 11 is an illustration of an embodiment of a frame assembly for a modular platform member used with a setback platform system in accordance with some embodiments.
Figure 12:
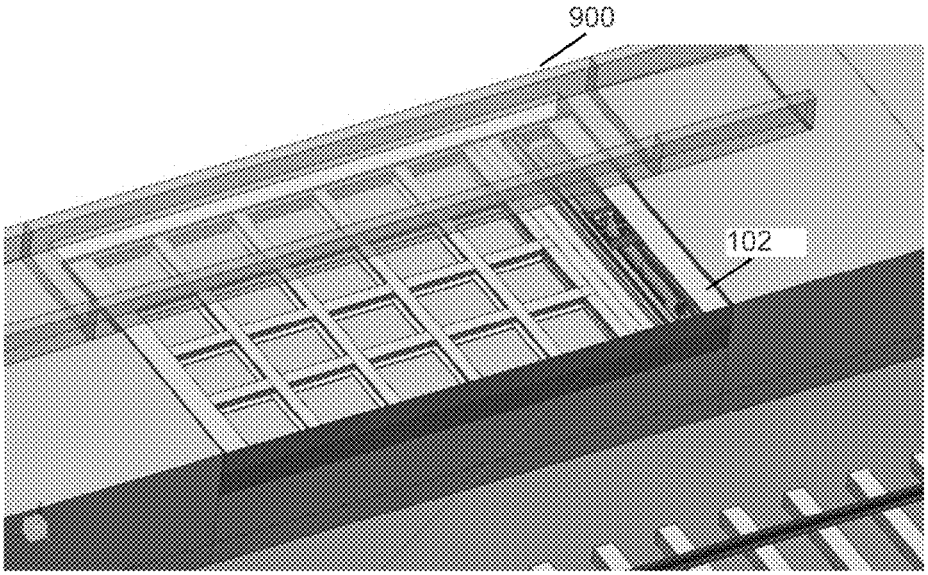
FIG. 12 is an illustration of a setback platform system in accordance with some embodiments.
Figure 13:
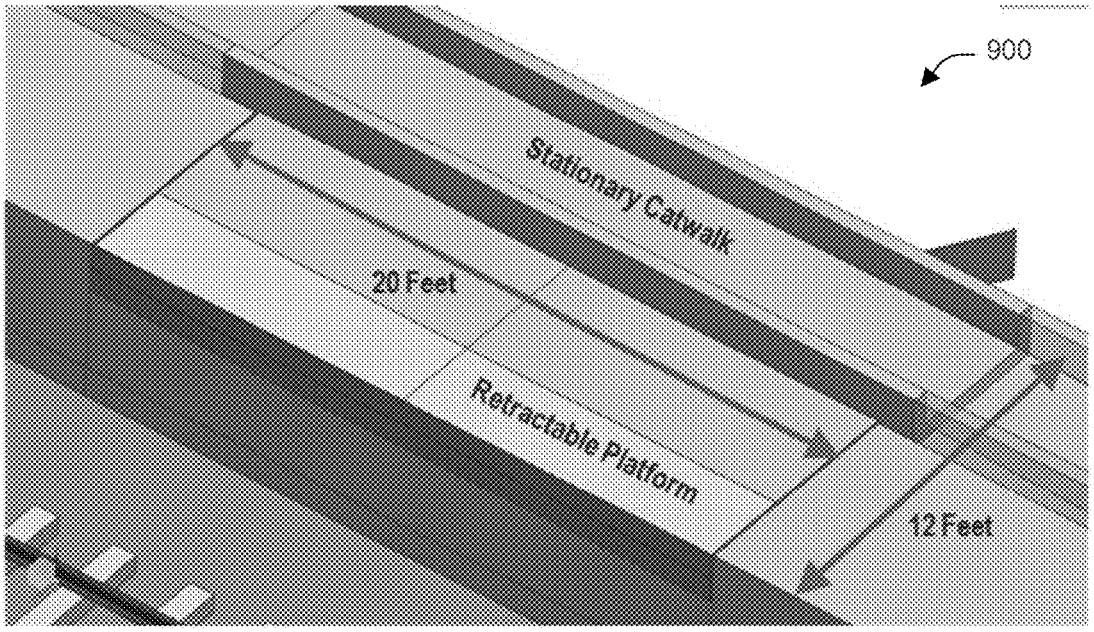
FIG. 13 is an illustration of a setback platform system in accordance with some embodiments.
Figure 14:
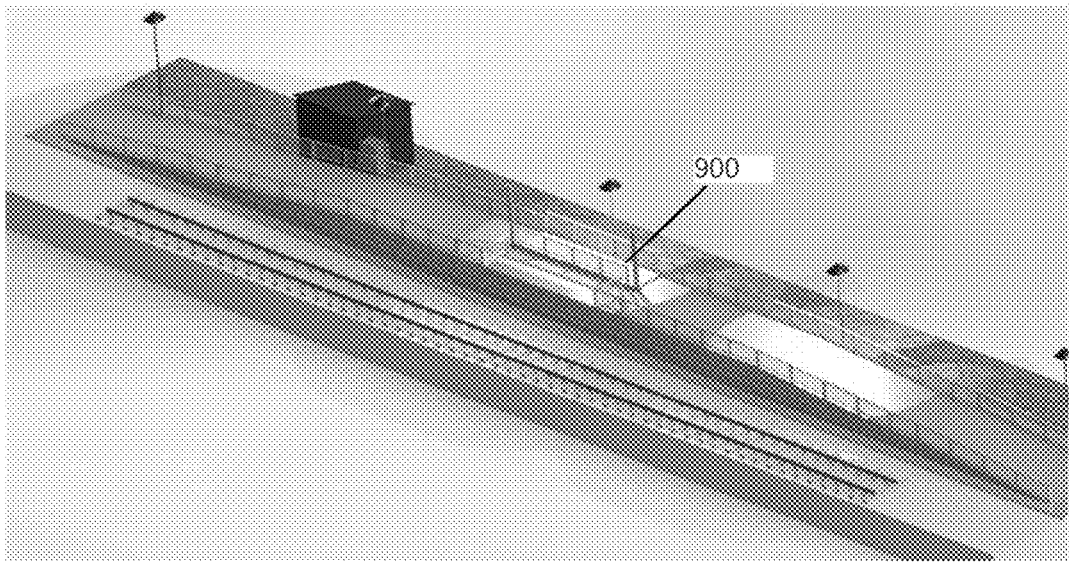
FIG. 14 is an illustration of a setback platform system in accordance with some embodiments.
Figure 15:
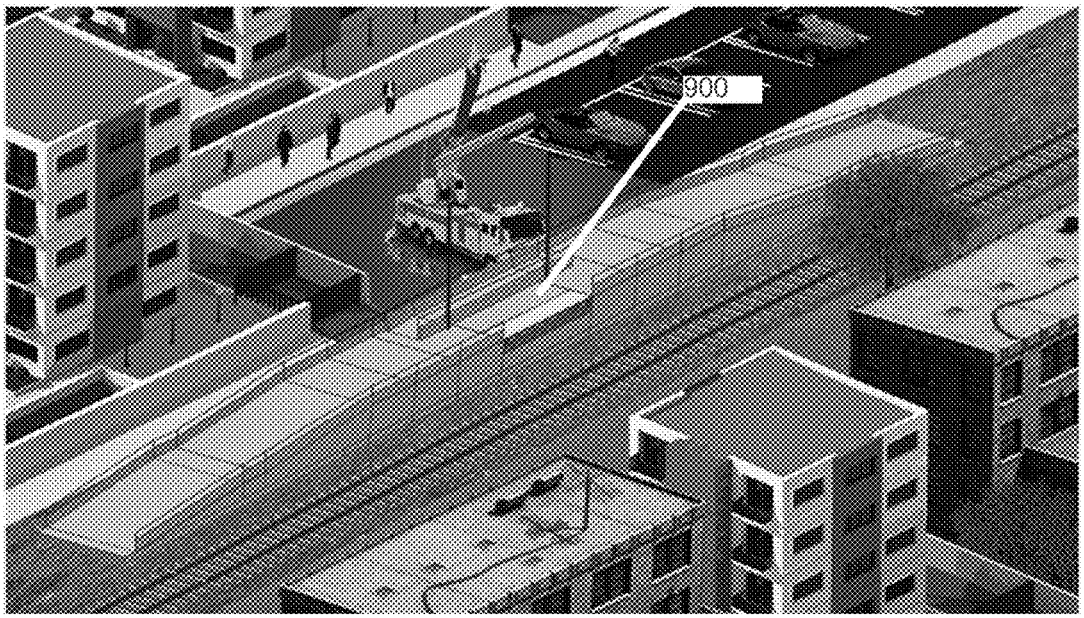
FIG. 15 is an illustration of a setback platform system in accordance with some embodiments.
Figure 16:
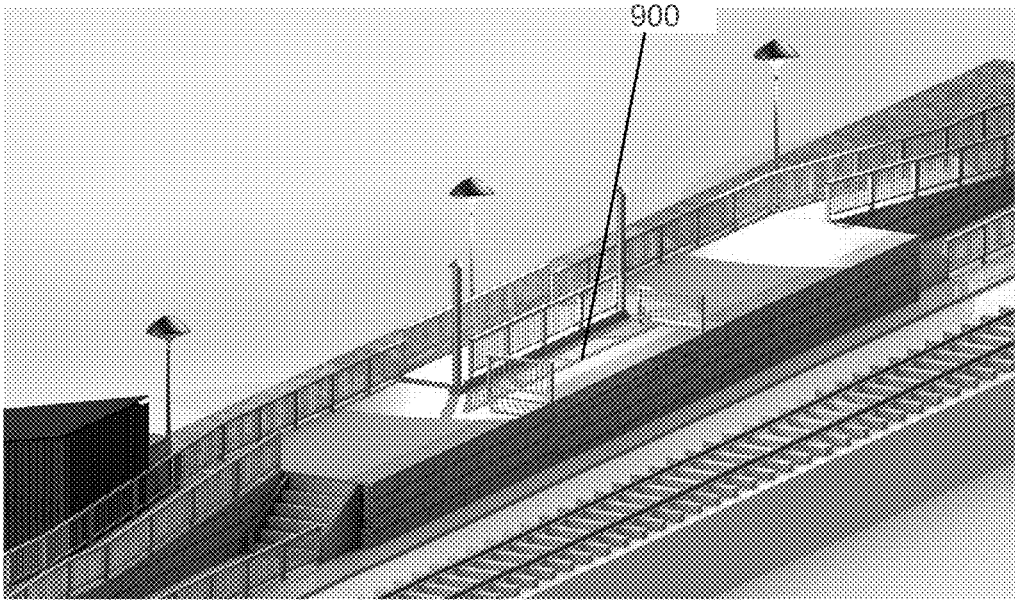
FIG. 16 is an illustration of a setback platform system in accordance with some embodiments.
Figure 17:
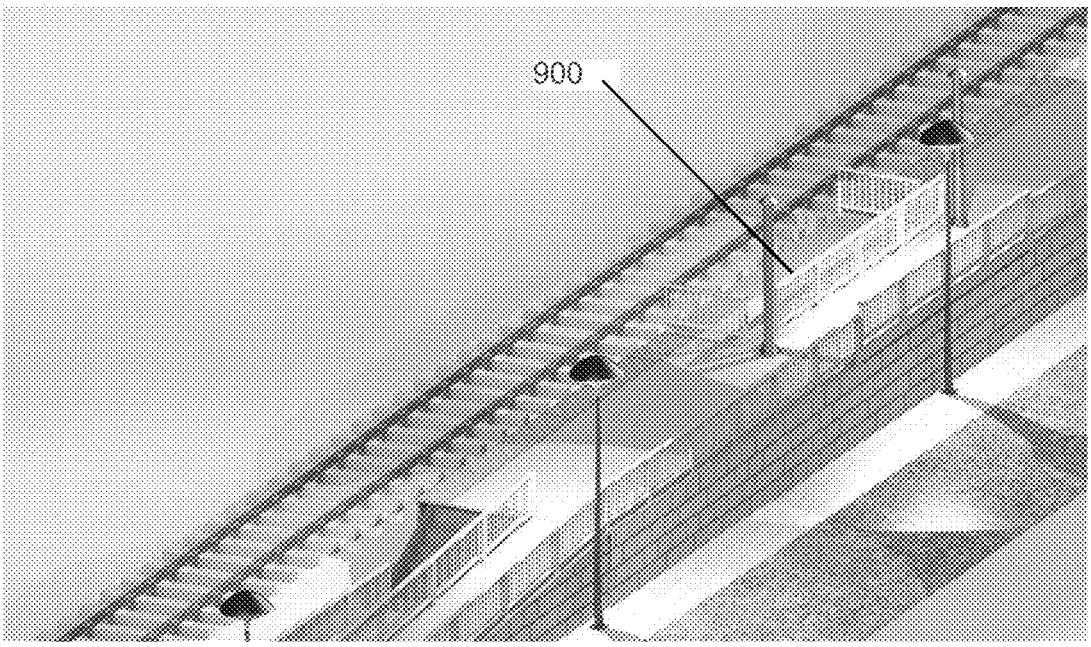
FIG. 17 is an illustration of a setback platform system in accordance with some embodiments.

FIGS. 10 and 11 illustrate a frame assembly 1001 in accordance with some embodiments.

FIGS. 9 and 12-17 illustrate the setback platform system 900 having a shuttle platform 102 and one or more modular platform members. The modular platform members are one or more of individual members that are arranged together or coupled to one another to create a setback platform system 900 for a rail system. Each modular platform member includes connection brackets allowing each concrete section to be attached and connected in a modular fashion. In some embodiments, each modular platform member includes an integrated heating unit, capable of being connected with adjacent sections for continuity among the setback platform system. In some embodiments, the integrated heating unit comprises an integrated heating wire and/or an electrical heat box assembly. In some embodiments, the electrical heat box assembly is or includes the controller component 120. In other embodiments, the electrical heat box assembly comprises a separate controller component different from the controller component 120. In some embodiments, at least one modular platform member has an integrated guard rail. In some embodiments, each modular platform member is configured to receive a guardrail configured to be attached to the modular platform member. In some embodiments, at least one modular platform member includes threaded inserts for guard rail attachment. In some embodiments, at least one modular platform member is configured to accommodate a canopy attachment, a roof, an overhang, an overhead structure, or some other suitable structure. In some embodiments, one or more modular platform members has a strength rating of at least 150 pounds per square inch. In some embodiments, the setback platform system is comprises embossed coverings or finishes. In some embodiments, each modular platform member can includes a break away edge.

The aforementioned systems (e.g., the shuttle platform 102, the controller component 120, the modular platform member, etc.), architectures, environments, and the like have been described with respect to interaction between several components and/or elements. It should be appreciated that such components, devices, and elements can include those elements or sub-elements specified therein, some of the specified elements or sub-elements, and/or additional elements. Further yet, one or more elements and/or sub-elements may be combined into a single component to provide aggregate functionality. The elements may also interact with one or more other elements not specifically described herein for the sake of brevity, but known by those of skill in the art.

In some embodiments, a support structure is incorporated into the setback platform and affixed to the ground level to provide structural support to the shuttle platform. In some embodiments, a guide system is coupled to the shuttle platform for the linear movement. In some embodiments, a drive component is configured to actuate the shuttle platform. In some embodiments, a motion sensor is configured to detect a movement in an area between the front edge and the centerline, wherein the drive component is disabled based on a detection of the movement. In some embodiments, a remote signal is communicated from the commuter, regional and intercity rail vehicle to activate the linear movement of the shuttle platform from at least one of the first position to the second position or the second position to the first position.

In some embodiments, the setback platform system includes a solenoid device is configured to control a physical connection between a bottom portion of the shuttle platform and a guide system that is actuated in the linear movement with a screw drive. In some embodiments, the setback platform system includes a disconnect device configured to disconnect the physical connection between a bottom portion of the shuttle platform and the guide system to prevent the screw drive from providing the linear movement, wherein the disconnect device is configured to connect a gear mechanism that is configured to provide the linear movement rather than the screw drive.

In some embodiments, the setback platform system includes a power source configured to deliver electrical power to provide at least the linear movement. In some embodiments, the setback platform systems includes a controller component configured to control the shuttle platform, and, in particular, at least the motion of the shuttle platform from the first position to the second position. In some embodiments, an audible alert is activated during the linear movement from at least one of the first to the second position or the second position to the first position. In some embodiments, a railing is affixed to at least one of the first path or the shuttle platform. In some embodiments, a visible alert is activated during the linear movement of the shuttle platform from at least one of the first to the second position or the second position to the first position.

In an aspect, incorporated is an APPENDIX A (attached). APPENDIX A is a document that describes aspects of the claimed subject matter, and this Appendix forms part of this specification.

In an aspect, incorporated is an APPENDIX B (attached). APPENDIX B is a document that describes aspects of the claimed subject matter, and this Appendix forms part of this specification.

In an aspect, incorporated is an APPENDIX C (attached). APPENDIX C is a document that describes aspects of the claimed subject matter, and this Appendix forms part of this specification.

In an aspect, incorporated is an APPENDIX D (attached). APPENDIX D is a document that describes aspects of the claimed subject matter, and this Appendix forms part of this specification.

In an aspect, incorporated is an APPENDIX E (attached). APPENDIX E is a document that describes aspects of the claimed subject matter, and this Appendix forms part of this specification.

In an aspect, incorporated is an APPENDIX F (attached). APPENDIX F is a document that describes aspects of the claimed subject matter, and this Appendix forms part of this specification.

In an aspect, incorporated is an APPENDIX G (attached). APPENDIX G is a document that describes aspects of the claimed subject matter, and this Appendix forms part of this specification.

In an aspect, incorporated is an APPENDIX H (attached). APPENDIX H is a document that describes aspects of the claimed subject matter, and this Appendix forms part of this specification.

In an aspect, incorporated is an APPENDIX I (attached). APPENDIX I is a document that describes aspects of the claimed subject matter, and this Appendix forms part of this specification.

While the above disclosed system and methods can be described in the general context of computer-executable instructions of a program that runs on one or more computers, those skilled in the art will recognize that aspects can also be implemented in combination with other program modules or the like. Generally, program modules include routines, programs, components, data structures, among other things that perform particular tasks and/or implement particular abstract data types. Moreover, those skilled in the art will appreciate that the above systems and methods can be practiced with various computer system configurations, including single-processor, multi-processor or multi-core processor computer systems, mini-computing devices, mainframe computers, as well as personal computers, hand-held computing devices (e.g., personal digital assistant (PDA), portable gaming device, smartphone, tablet, Wi-Fi device, laptop, phone, among others), microprocessor-based or programmable consumer or industrial electronics, and the like. Aspects can also be practiced in distributed computing environments where tasks are performed by remote processing devices that are linked through a communications network. However, some, if not all aspects of the claimed subject matter can be practiced on stand-alone computers. In a distributed computing environment, program modules may be located in one or both of local and remote memory storage devices.

Figure 18:
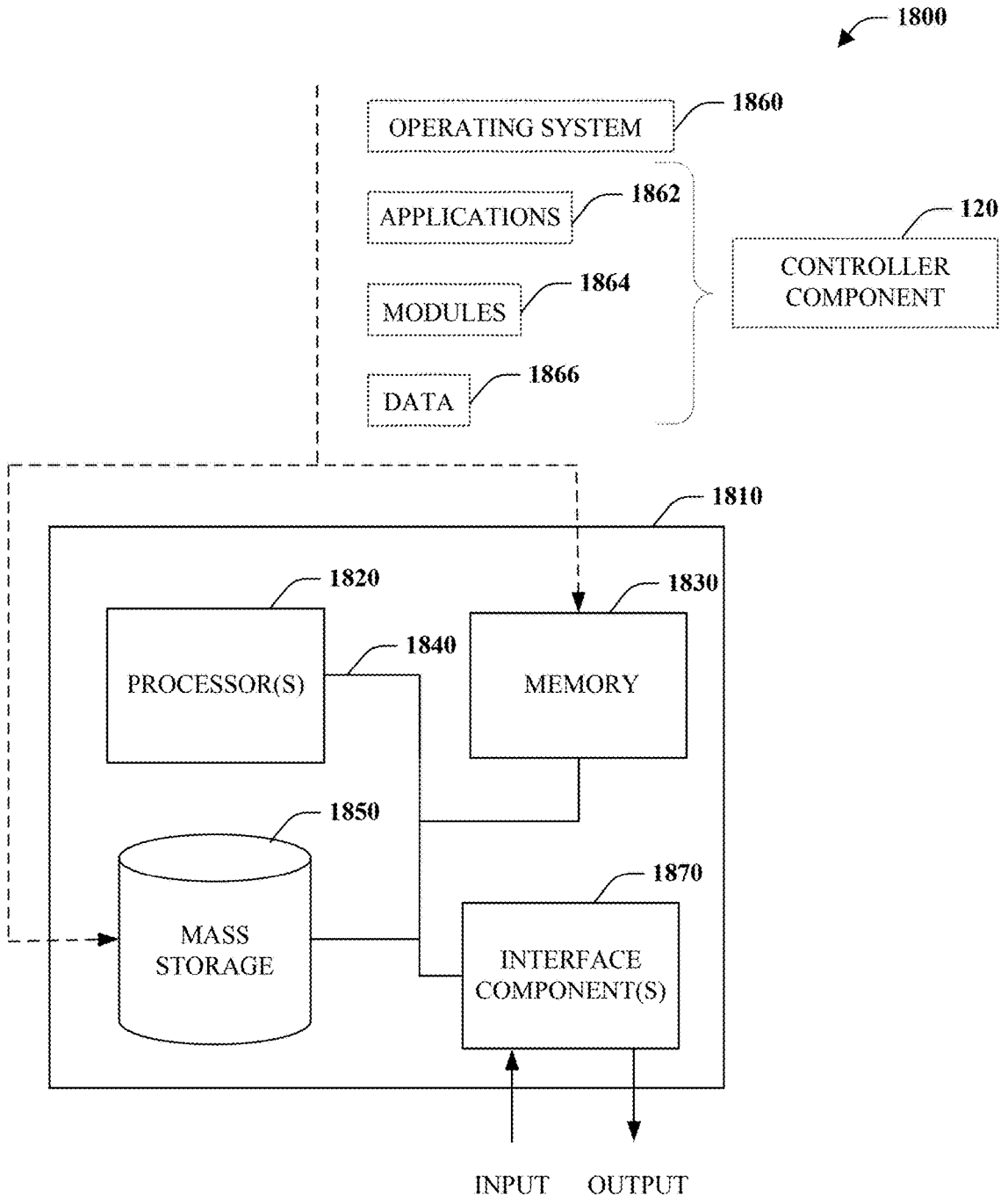
FIG. 18 is a schematic block diagram illustrating a system by which one or more embodiments is implemented.

FIG. 18 is an example general-purpose computer 1810 or computing device (e.g., desktop, laptop, server, hand-held, programmable consumer or industrial electronics, set-top box, game system . . . ) by which an embodiment is implemented. The computer 1810 includes one or more processor(s) 1820, memory 1830, system bus 1840, mass storage 1850, and one or more interface components 1870. The system bus 1840 communicatively couples at least the above system components. However, it is to be appreciated that in its simplest form the computer 1810 can include one or more processors 1820 coupled to memory 1830 that execute various computer executable actions, instructions, and or components stored in memory 1830.

The processor(s) 1820 can be implemented with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any processor, controller, microcontroller, or state machine. The processor(s) 1820 may also be implemented as a combination of computing devices, for example a combination of a DSP and a microprocessor, a plurality of microprocessors, multi-core processors, one or more microprocessors in conjunction with a DSP core, or any other such configuration.

The computer 1810 can include or otherwise interact with a variety of computer-readable media to facilitate control of the computer 1810 to implement one or more aspects of the claimed subject matter. The computer-readable media can be any available media that can be accessed by the computer 1810 and includes volatile and nonvolatile media, and removable and non-removable media. By way of example, and not limitation, computer-readable media may comprise computer storage media and communication media.

Computer storage media includes volatile and nonvolatile, removable and non-removable media implemented in any method or technology for storage of information such as computer-readable instructions, data structures, program modules, or other data. Computer storage media includes, but is not limited to memory devices (e.g., random access memory (RAM), read-only memory (ROM), electrically erasable programmable read-only memory (EEPROM) . . . ), magnetic storage devices (e.g., hard disk, floppy disk, cassettes, tape . . . ), optical disks (e.g., compact disk (CD), digital versatile disk (DVD) . . . ), and solid state devices (e.g., solid state drive (SSD), flash memory drive (e.g., card, stick, key drive . . . ) . . . ), or any other medium which can be used to store the desired information and which can be accessed by the computer 1810.

Communication media typically embodies computer-readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer-readable media.

Memory 1830 and mass storage 1850 are examples of computer-readable storage media. Depending on the exact configuration and type of computing device, memory 1830 may be volatile (e.g., RAM), non-volatile (e.g., ROM, flash memory . . . ) or some combination of the two. By way of example, the basic input/output system (BIOS), including basic routines to transfer information between elements within the computer 1810, such as during start-up, can be stored in nonvolatile memory, while volatile memory can act as external cache memory to facilitate processing by the processor(s) 1820, among other things.

Mass storage 1850 includes removable/non-removable, volatile/non-volatile computer storage media for storage of large amounts of data relative to the memory 1830. For example, mass storage 1850 includes, but is not limited to, one or more devices such as a magnetic or optical disk drive, floppy disk drive, flash memory, solid-state drive, or memory stick.

Memory 1830 and mass storage 1850 can include, or have stored therein, operating system 1860, one or more applications 1862, one or more program modules 1864, and data 1866. The operating system 1860 acts to control and allocate resources of the computer 1810. Applications 1862 include one or both of system and application software and can exploit management of resources by the operating system 1860 through program modules 1864 and data 1866 stored in memory 1830 and/or mass storage 1850 to perform one or more actions. Accordingly, applications 1862 can turn a general-purpose computer 1810 into a specialized machine in accordance with the logic provided thereby.

All or portions of the claimed subject matter can be implemented using standard programming and/or engineering techniques to produce software, firmware, hardware, or any combination thereof to control a computer to realize the disclosed functionality. By way of example and not limitation, the controller component 120, or portions thereof, can be, or form part, of an application 1862, and include one or more modules 1864 and data 1866 stored in memory and/or mass storage 1850 whose functionality can be realized when executed by one or more processor(s) 1820.

In accordance with one particular embodiment, the processor(s) 1820 can correspond to a system on a chip (SOC) or like architecture including, or in other words integrating, both hardware and software on a single integrated circuit substrate. Here, the processor(s) 1820 can include one or more processors as well as memory at least similar to processor(s) 1820 and memory 1830, among other things. Conventional processors include a minimal amount of hardware and software and rely extensively on external hardware and software. By contrast, an SOC implementation of processor is more powerful, as it embeds hardware and software therein that enable particular functionality with minimal or no reliance on external hardware and software. For example, the controller component 120, and/or associated functionality can be embedded within hardware in a SOC architecture.

The computer 1810 also includes one or more interface components 1870 that are communicatively coupled to the system bus 1840 and facilitate interaction with the computer 1810. By way of example, the interface component 1870 can be a port (e.g. serial, parallel, PCMCIA, USB, FireWire . . . ) or an interface card (e.g., sound, video . . . ) or the like. In one example implementation, the interface component 1870 can be embodied as a user input/output interface to enable a user to enter commands and information into the computer 1810 through one or more input devices (e.g., pointing device such as a mouse, trackball, stylus, touch pad, keyboard, microphone, joystick, game pad, satellite dish, scanner, camera, other computer . . . ). In another example implementation, the interface component 1870 can be embodied as an output peripheral interface to supply output to displays (e.g., CRT, LCD, plasma . . . ), speakers, printers, and/or other computers, among other things. Still further yet, the interface component 1870 can be embodied as a network interface to enable communication with other computing devices (not shown), such as over a wired or wireless communications link.

An aspect of this description is directed to a modular platform system for a shared track rail system on a ground level that is used by a commuter, regional and intercity rail vehicle and a freight vehicle. The modular platform system can be utilized in conjunction with a setback platform system, wherein the module platform system provides adaptability to various landscapes or elevations and such modular platform members can be coupled to one another. Moreover, the modular platform system can include modular platform members that are electrically and/or physically coupled together, wherein a controller component can be configured to manage electrical signals or control to one or more of the modular platform members.

The modular platform system is configured to provide modularity to allow for installation of a platform system for a track rail system on various levels of a ground; integrated heating or cooling elements within each modular platform member, wherein the members can be in electrical communication with one another and/or a controller component; one or more members incorporated with one or more of the modular platform members of the system to receive or attach a guardrail, a railing, a fence, or a handrail; customizable height for the modular platform member in which the customizable height can include steps, ramps, elevation changes, gradual slopes, gradual declines, etc.; the modular platform member(s) having one or more members to receive or attach supports for a canopy, roof, or overhang structure; a load capacity of at least 150 psi (pounds per square inch); adaptability for installation on various footings; sides of the modular platform members to receive or have affixed customizable finishes, facades, faces, or skins, wherein the sides can include emblems, logos, writing, etc.; the modular platform members can be created off-site and installed by placing on an excavated level or pre-defined height; and each modular platform member can include a breakaway edge.

Another aspect of this description is related to a setback platform for a shared track rail system on a ground level that is used by a commuter, regional and intercity rail vehicle and a freight vehicle. The setback platform system comprises at least one of the following: a setback platform that is substantially parallel to the shared track rail system and is approximately nine (9) feet from a centerline of the shared track rail system; a first path at a first height along and on top of the setback platform; a shuttle platform coupled to the setback platform that actuates from a first position to a second position with a linear movement toward the centerline or from a second position to the first position with a linear movement away from the centerline in a plane that is parallel to the ground level, the shuttle platform is at a second height along and on top of the setback platform and includes a front edge, a rear edge opposite thereto, and a thickness, wherein the first height is greater than the second height; in the first position, a portion of the shuttle platform is situated below the first path and the front edge is approximately nine (9) feet from the centerline; in the second position, the portion of the shuttle is adjacent to the first path and the front edge is a distance from the centerline, wherein the distance is between five (5) feet six (6) inches and five (5) eight (8) inches; the shuttle platform provides a path in the second position to allow passengers to board the commuter, regional and intercity rail vehicle; and the shuttle platform in the first position creates a second path that allows travel about the setback platform.

A further aspect of this description is related to a modular platform system that comprises a setback platform system for a shared track rail system on a ground level. The shared track rail system is usable by a commuter, regional and intercity rail vehicle and a freight vehicle. The setback platform comprises a first path at a first height with respect to the ground level. The setback platform also comprises a shuttle platform. The shuttle platform is at a second height in a first position different from the first height. The shuttle platform is configured to be moved from the first position to a second position different from the first position. A front edge of the shuttle platform is farther away from a centerline of the shared track rail system if the shuttle platform is in the first portion than if the shuttle platform is in the second position.

Another aspect of this description is related to a modular platform system that comprises a setback platform system for a shared track rail system on a ground level. The shared track rail system is usable by a commuter, regional and intercity rail vehicle and a freight vehicle. The setback platform comprises a first path at a first height with respect to the ground level. The setback platform also comprises a shuttle platform. The shuttle platform is at a second height in a first position different from the first height. The shuttle platform is configured to be moved from the first position to a second position different from the first position. A front edge of the shuttle platform is farther away from a centerline of the shared track rail system if the shuttle platform is in the first portion than if the shuttle platform is in the second position. The setback platform further comprises a first modular platform member on a first side of the shuttle platform. The setback platform additionally comprises a second modular platform member on a second side of the shuttle platform opposite the first side. The first modular platform member and the second modular platform member are block-shaped. The first path comprises the first modular platform member and the second modular platform member.

Another aspect of this description is related to a method for extending a shuttle platform of a setback platform. The method comprises receiving a request to move the shuttle platform from a first position to a second position. The setback platform is configured to service a shared track rail system usable by a commuter, regional and intercity rail vehicle and a freight vehicle. The setback platform has a first path at a first height with respect to a ground level and a second path at a second height with respect to the ground level. The method also comprises moving the shuttle platform based on the request toward the shared rail system. Moving the shuttle platform toward the shared rail system causes a width of the second path to increase. The method further comprises stopping movement of the shuttle platform based on a detected motion between the setback platform and the shared track rail system.

What has been described above includes examples of the subject innovation. It is, of course, not possible to describe every conceivable combination of components or methodologies for purposes of describing the claimed subject matter, but one of ordinary skill in the art may recognize that many further combinations and permutations of the subject innovation are possible. Accordingly, the claimed subject matter is intended to embrace all such alterations, modifications, and variations that fall within the spirit and scope of the appended claims.

One of ordinary skill in the art will readily recognize that the discussed embodiments may have other applications in other environments. In fact, many embodiments and implementations are possible. The following claims are in no way intended to limit the scope of the subject innovation to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means."

The aforementioned systems have been described with respect to interaction between several components. It can be appreciated that such systems and components can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components. Any components described herein may also interact with one or more other components not specifically described herein but generally known by those of skill in the art.

Although the subject innovation has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (e.g., components, devices, etc.), the terms (including a reference to a "means") used to describe such elements are intended to correspond, unless otherwise indicated, to any element which performs the specified function of the described element (e.g., that is functionally equivalent), even though not structurally equivalent to the disclosed structure which performs the function in the herein illustrated exemplary embodiment or embodiments of the innovation. In addition, while a particular feature of the innovation may have been described above with respect to only one or more of several illustrated embodiments, such feature may be combined with one or more other features of the other embodiments, as may be desired and advantageous for any given or particular application. Although certain embodiments have been shown and described, it is understood that equivalents and modifications falling within the scope of the appended claims will occur to others who are skilled in the art upon the reading and understanding of this specification.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, any use of the terms "first," "second," etc., do not denote any order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A modular platform system, comprising:

a setback platform system for a shared track rail system on a ground level, the setback platform comprising:

a first path at a first height with respect to the ground level;

a shuttle platform, the shuttle platform being at a second height in a first position different from the first height, and configured to be moved from the first position to a second position different from the first position, wherein a front edge of the shuttle platform is farther away from a centerline of the shared track rail system if the shuttle platform is in the first portion than if the shuttle platform is in the second position;

a first modular platform member proximate to a first end of the setback platform; and a second modular platform member proximate to a second end of the setback platform opposite the first end, wherein each of the first modular platform member and the second modular platform member comprises:

a heating element;

a wire lead coupled with the heating element and configured to be coupled with an additional wire lead from an adjacent modular platform member; and a controller component configured to manage an electric current through the heating element of the first modular platform member or the second modular platform member.

2. The modular platform system of claim 1, wherein the shuttle platform is configured to be moved in a linear direction toward and away from the centerline of the shared rail track system.

3. The modular platform system of claim 2, wherein the linear direction is in a plane substantially parallel to the ground level.

4. The modular platform system of claim 1, wherein the shuttle platform is configured to be moved in a non-linear direction toward and away from the centerline of the shared rail track system.

5. The modular platform system of claim 1, wherein the shuttle platform is configured such that at least a portion of the shuttle platform is under the first path if the shuttle platform is in the first position.

6. The modular platform system of claim 1, wherein the shuttle platform is configured such that the shuttle platform is entirely under the first path if the shuttle platform is in the first position.

7. The modular platform system of claim 1, wherein the first height is greater than the second height.

8. The modular platform system of claim 1, wherein the second height is greater than the first height.

9. The modular platform system of claim 1, wherein the front edge of the shuttle platform is at least a predetermined distance away from the centerline of the shared rail track system if the shuttle platform is in the first position.

10. The modular platform system of claim 9, wherein the predetermined distance is nine (9) feet.

11. The modular platform system of claim 1, wherein the front edge of the shuttle platform is between about five (5) feet six (6) inches and about five (5) feet eight (8) inches away from the centerline of the shared track rail system if the shuttle platform is in the second position.

12. The modular platform system of claim 1, wherein the shuttle platform is configured to provide a second path if the shuttle platform is in the second position to allow passengers to board a commuter, regional and intercity rail vehicle.

13. The modular platform system of claim 1, wherein the shuttle platform is configured to provide a second path that allows travel about the setback platform if the shuttle platform is in the first position, and moving the shuttle platform from the first position to the second position expands the second path.

14. The modular platform system of claim 1, wherein at least one of the first modular platform member or the second modular platform member comprises a frame assembly configured to support the first path.

15. The modular platform system of claim 14, wherein the first path comprises concrete.

16. The modular platform system of claim 1, wherein the shuttle platform comprises a shuttle platform heating element; and the controller component is further configured to manage the electric current through the shuttle platform heating element.

17. The modular platform system of claim 1, further comprising:

a support structure extending upward from the ground level and configured to support to the shuttle platform.

18. A modular platform system, comprising:

a setback platform system for a shared track rail system on a ground level, the setback platform comprising:

a first path at a first height with respect to the ground level;

a shuttle platform, the shuttle platform being at a second height in a first position different from the first height, and configured to be moved from the first position to a second position different from the first position, wherein a front edge of the shuttle platform is farther away from a centerline of the shared track rail system if the shuttle platform is in the first portion than if the shuttle platform is in the second position;

a first modular platform member on a first side of the shuttle platform; and a second modular platform member on a second side of the shuttle platform opposite the first side, wherein the first modular platform member and the second modular platform member are block-shaped, and the first path comprises the first modular platform member and the second modular platform member; and wherein each of the first modular platform member and the second modular platform member comprises:

a heating element;

a wire lead coupled with the heating element and configured to be coupled with an additional wire lead from an adjacent modular platform member; and a controller component configured to manage an electric current through the heating element of the first modular platform member or the second modular platform member.

19. A method, comprising:

requesting to move one or more modular platform member of a shuttle platform of a setback platform from a first position to a second position, the setback platform being configured to service a shared track rail system, and having a first path at a first height with respect to a ground level and a second path at a second height with respect to the ground level;

wherein the shuttle platform comprises:

a first modular platform member on a first side of the shuttle platform; and a second modular platform member on a second side of the shuttle platform opposite the first side, wherein each of the first modular platform member and the second modular platform member comprises:

a heating element a wire lead coupled with the heating element and configured to be coupled with an additional wire lead from an adjacent modular platform member; and a controller component configured to manage an electric current through the heating element of the first modular platform member or the second modular platform member moving the shuttle platform based on the request toward the shared rail system, wherein moving the shuttle platform toward the shared rail system causes a width of the second path to increase; and stopping movement of the shuttle platform based on a detected motion between the setback platform and the shared track rail system.

* * * * *